US007990322B1

(12) United States Patent
Nalbandian

(10) Patent No.: US 7,990,322 B1
(45) Date of Patent: Aug. 2, 2011

(54) SHORTENED HF AND VHF ANTENNAS MADE WITH CONCENTRIC CERAMIC CYLINDERS

(75) Inventor: Vahakn Nalbandian, Schwenksville, PA (US)

(73) Assignee: The United States of America as respresented by the Secretary of the Army, Washington, DC (US)

( * ) Notice: Subject to any disclaimer, the term of this patent is extended or adjusted under 35 U.S.C. 154(b) by 212 days.

(21) Appl. No.: 12/459,116

(22) Filed: Jun. 18, 2009

(51) Int. Cl.
*H01Q 1/38* (2006.01)

(52) U.S. Cl. ..... 343/700 MS; 343/848

(58) Field of Classification Search ..... 343/700 MS, 343/846, 848
See application file for complete search history.

(56) References Cited

U.S. PATENT DOCUMENTS 6,362,785 B1 * 3/2002 Nalbandian et al. ... 343/700 MS
6,567,045 B2 * 5/2003 Suguro et al. ..... 343/700 MS
2002/0113743 A1 * 8/2002 Judd et al. ..... 343/757
* cited by examiner

*Primary Examiner* — Tan Ho
(74) *Attorney, Agent, or Firm* — Michael Zelenka; Stephen J. Harbulak

(57) ABSTRACT

Electrically small shortened HF and VHF microstrip cylindrical antenna with a reduced antenna length are provided. The electrically small shortened HF and VHF microstrip cylindrical antennas are constructed with concentric, ceramic cylinders having copper coating that operate at low frequencies. The concentric, ceramic cylinders alternate with concentric copper layers in a corrugated alternating structure where certain copper layers function as the ground plane and others function as part of the radiating patch providing both a shortened antenna length and the ability to operate efficiently at low frequencies. It is now possible to provide a ten-fold size reduction with these antennas.

18 Claims, 6 Drawing Sheets

SHORTENED HF AND VHF ANTENNAS MADE WITH CONCENTRIC CERAMIC CYLINDERS

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to the field of microstrip antennas, and more particularly to shortened omni-directional HF and VHF cylindrical microstrip antennas.

BACKGROUND OF THE INVENTION

Microstrip antennas are light weight, low profile, and low cost conformal structures; they could be planar, cylindrical or other shapes, replacing bulky antennas in many applications. Monopole antennas are also a low cost type of antenna, but as the monopole antenna's frequency goes down to VHF and lower frequencies, its length becomes too large and cumbersome, making it inapplicable for a number of applications. Monopole and cylindrical microstrip antennas are used to provide azimuthal omni-directional coverage. As the length of monopole antenna is reduced to less than one quarter wavelength, its efficiency quickly deteriorates. Since antennas increase in size as the frequency gets lower and lower, prior art antennas tend to become more and more cumbersome and inefficient.

Current conventional cylindrical microstrip antennas also suffer from the disadvantage of requiring several large and complex microstrip patches that need to be connected to transmission lines. Current conventional cylindrical microstrip antennas typically have microstrip patches that are about one half wavelength within the dielectric medium, while the length of an efficient monopole antenna is one quarter wavelength. One example of this type of prior art cylindrical antenna is this inventor's U.S. Pat. No. 6,362,785 entitled "Compact Cylindrical Microstrip Antenna" and FIGS. 1-3, depict side, front, and top views of that prior art arrangement. FIGS. 1 and 2 depict a radiating patch 1 etched on a tubular, dielectric microstrip substrate 2 and a copper patch 3 etched on one side surrounding a concentric, copper cylindrical ground plane 4. The substrate 3 fits closely around the cylindrical ground plane 4. FIG. 3 illustrates the prior art's radiating patch 3 being divided into a wide section 5 and a narrow section 6 that is soldered to the ground plane 4 and coupled to a coaxial feed 7. FIG. 3 also illustrates representative dimensions for this type of prior art antenna with a width, 2r, of 124.0 mm and length, d, of 12.6 mm for the wide section 5, width, 2t, of 3.2 mm and length, c, of 10.0 mm for the narrow section 6, with the wide section 5 having a greater width than the narrow section 6. The combined length of the wide section 5 and narrow section 6 is 22.6 mm. A patch length of 230 mm would be needed from a conventional cylindrical antenna at the same frequency. Referring back to FIG. 1, a radiating sleeve 11 with those representative dimensions, along with a 31 mil thick microstrip material, such as Duroid, with a relative dielectric constant of 2.2, and outer diameter of 38.8 mm could provide an efficient microstrip antenna for the UHF frequencies with a resonant frequency of 422 MHz.

Such prior art antennas were configured to radiate at a frequency much lower than the expected frequency of a regular rectangular microstrip antenna. Although such prior art cylindrical antennas provided much-needed reductions in antenna length, they were still not suitable for low frequency applications.

Up until now, it has not been possible to employ cylindrical microstrip antennas at low frequencies without the disadvantages, limitations, and shortcomings associated with excessive antenna length, antenna size, and the need for large and complex transmission lines. Thus, there has been along-felt need for low frequency cylindrical microstrip antennas with a reduced length for even shorter cylindrical microstrip antennas.

SUMMARY OF THE INVENTION

In order to satisfy the long-felt need for low frequency cylindrical microstrip antennas with both reduced length and high efficiency that do not require the weight and excessive cost of complex and cumbersome transmission lines, the present invention provides a compact, or shortened, electrically small HF and VHF microstrip cylindrical antenna advantageously constructed with dielectric microstrip substrates of concentric ceramic cylinders with copper coating, with the copper coating either being the ground plane or etched to be used as the radiating patch, making it possible to have electrically small cylindrical microstrip antennas at low frequencies with a monopole-type radiation pattern and a significantly reduced antenna length. With this invention, an omni-directional shortened microstrip antenna is now provided for both VHF and even lower frequencies.

An electrically small cylindrical microstrip antenna at low frequencies offers a number of advantages over prior art antennas. The shortened cylindrical microstrip antenna of the present invention provides the same high efficiency as a quarter wavelength monopole and conventional microstrip antennas, with the key advantage over prior art antenna structures being a substantially shorter antenna length. In addition to the advantages of high efficiency and small size, the present invention provides omnidirectional azimuthal patterns useful in many military and commercial communication systems, without suffering from the size limitations of prior art antenna structures.

It is an object of the present invention to provide a shortened HF and VHF microstrip cylindrical antenna structure constructed with concentric cylinders of alternating dielectric and copper layers.

Another object of the present invention is to provide an electrically small shortened HF and VHF microstrip cylindrical antenna with a reduced antenna length that is constructed with concentric, ceramic cylinders having copper coating that operate at low frequencies.

It is still another object of the present invention to provide an electrically small, shortened HF and VHF microstrip cylindrical antenna constructed with concentric, ceramic cylinders that alternate with concentric copper layers where certain copper layers function as the ground plane and others function as part of the radiating patch providing both a shortened antenna length and the ability to operate efficiently at low frequencies.

Yet another object of the present invention is a method for providing an electrically small, shortened HF and VHF microstrip cylindrical antenna constructed with concentric, ceramic cylinders with copper coating and the ground plane arranged in a corrugated alternating layered structure.

These and other objects are advantageously accomplished with the present invention by providing a shortened cylindrical microstrip antenna comprising concentric, ceramic cylinders with copper coating advantageously arranged in a corrugated alternating layered structure. In one embodiment of the present invention, a reduced antenna length of at least 10% of the length of a conventional microstrip antenna has been achieved, resulting in smaller microstrip antennas at lower frequencies. Other embodiments of this invention provide a corrugated alternating structure with as many as seven alternating layers of the radiating patch, dielectric substrate, and concentric, ceramic cylindrical ground plane. The term "concentric" describes the relationship between the dielectric microstrip substrate made of ceramic or other microstrip material. The term "corrugated alternating structure" is defined as at least one layer of a dielectric material and at least one layer of any conductive material where the layers are bent or folded together, which could be a copper coating on the dielectric material that may be etched. In accordance with this invention's shortened HF and VHF antennas it is now possible to provide a ten-fold size reduction by increasing the ratio of wide strip width 2r to the narrow strip width 2t.

DETAILED DESCRIPTION OF THE DRAWINGS

Figure 4:
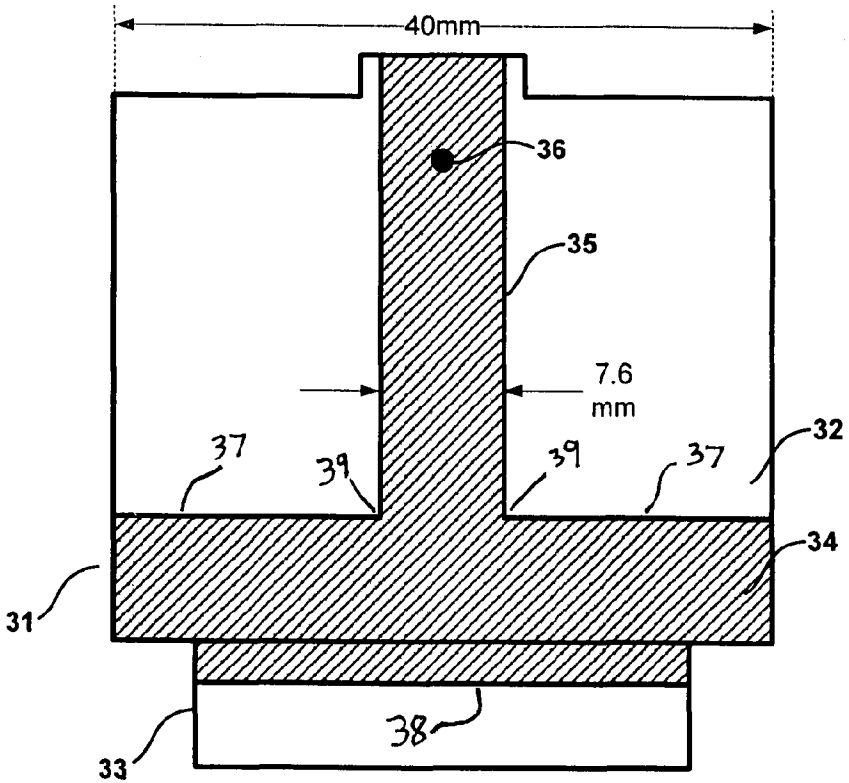
FIG. 4 is a side view of the corrugated alternating three-layered embodiment of the shortened cylindrical microstrip antenna of the present invention.
Figure 5:
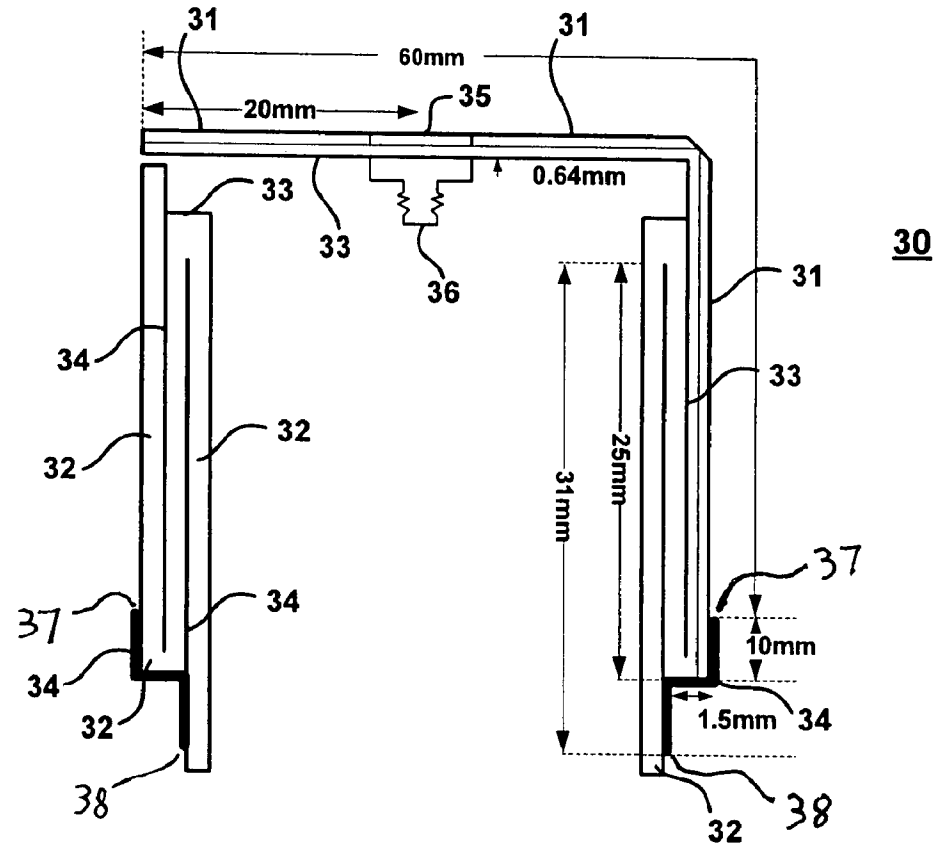
FIG. 5 is a cross sectional view taken through the cylindrical axis of the corrugated alternating three-layered embodiment of the present invention with representative dimensions.
Figure 6:
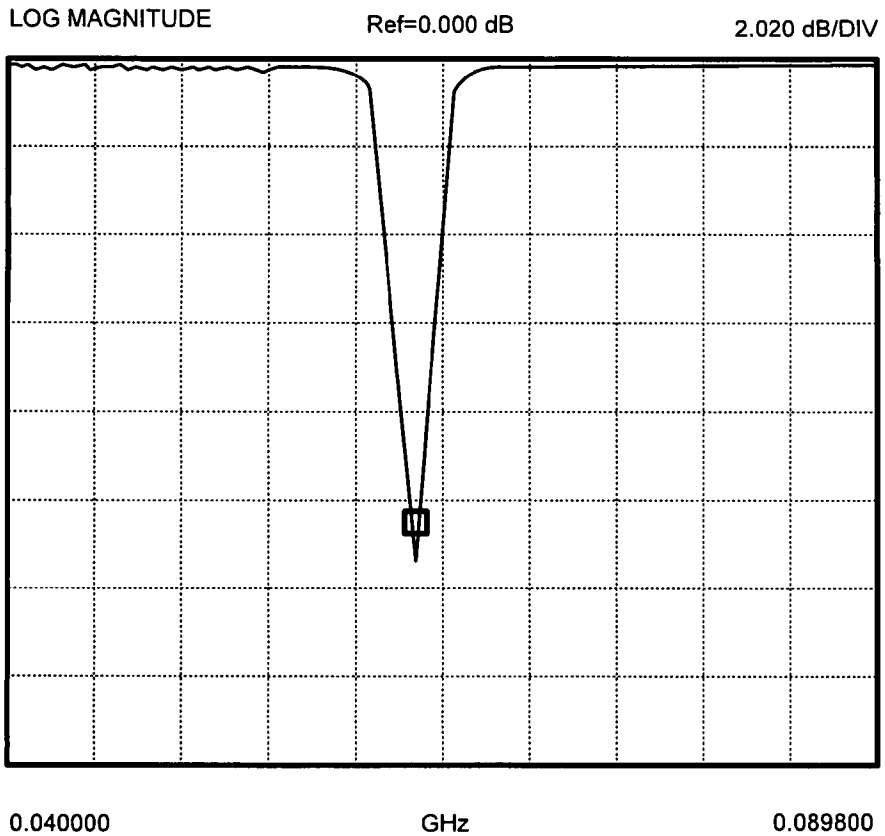
FIG. 6 is a graph showing a resonant frequency of 63 MHz for the FIG. 5 shortened cylindrical microstrip antenna of the present invention.
Figure 7:
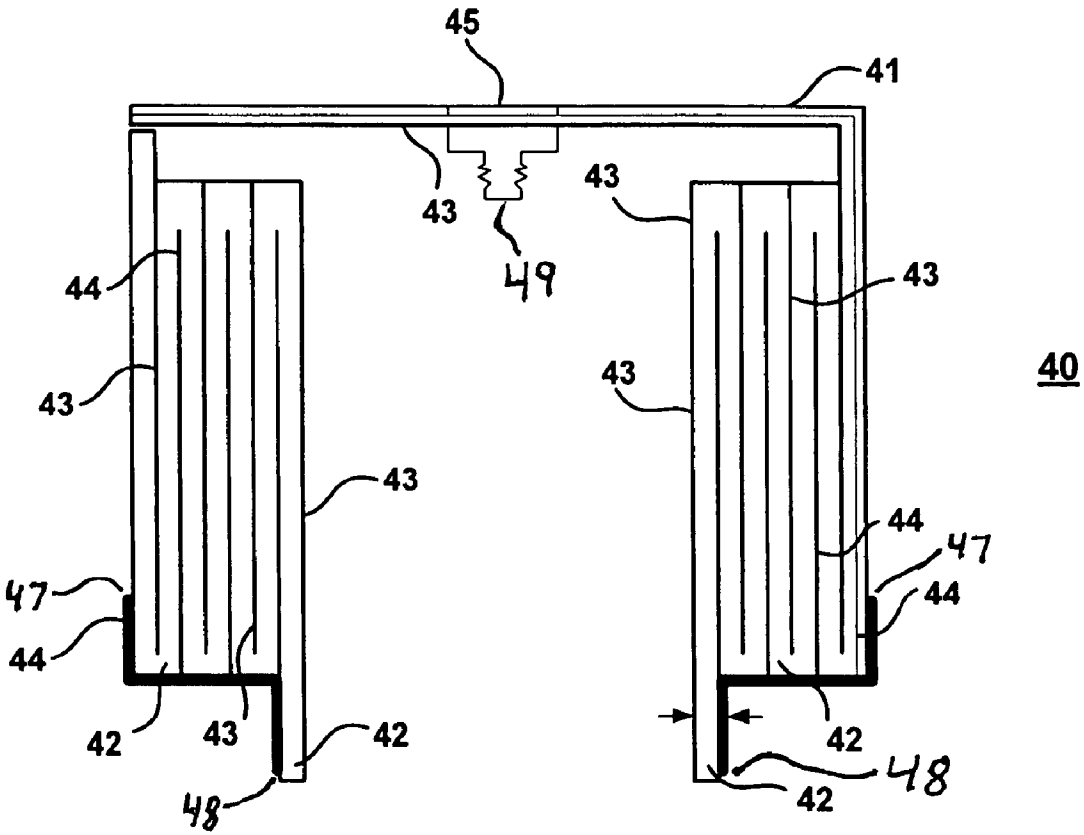
FIG. 7 is a cross sectional view taken through the cylindrical axis of the corrugated alternating seven-layered embodiment of the shortened cylindrical microstrip antenna of the present invention.

According to the present invention, it is now possible to provide a shortened cylindrical microstrip antenna comprising concentric, ceramic cylinders with copper coating advantageously arranged in a corrugated alternating layered structure. The essential feature of this invention is to achieve shortened antenna length by increasing the surface area of the radiating patch with an innovative corrugated alternating structure with as many as seven alternating layers of the dielectric material and at least one layer of any conductive material that are bent or folded together. In accordance with this invention's shortened HF and VHF antennas, it is now possible to greatly improve upon prior art size reduction efforts by bending the narrow strip portion 90 degrees lengthwise and making the length of the wide portions in multiple layers as illustrated in FIGS. 4, 5 and 7 with the results depicted on the FIG. 6 chart. The corrugated layers provide additional radiating surface along with the same geometrical size multilayer construction to provide an increased electrical length to the antenna and be able to reach VHF frequencies because the thickness of microstrip material is insignificant to the size.

In accordance with this invention, it is now possible to provide an electrically small, shortened HF and VHF microstrip cylindrical antenna constructed with concentric, ceramic cylinders with copper coating, and alternating layers of copper coating for the ground plane and the radiating patch although only the first and last layer of the circular radiating edge are exposed to radiate. This configuration restricts the number of ceramic layers to an odd number and also provides a shortened antenna length that operates at low frequencies. As the number of concentric ceramic cylinders with copper coating increases, the electrical path between the two radiating patches increases, so the length of the cylinder shrinks as the number of concentric layers are increased.

It should be noted that this invention provides a drastic reduction in antenna length as compared to prior art microstrip antennas and shrinks antenna length, relative to wavelength, considerably more. This advantageous decreased antenna length is achieved by employing concentric cylindrical dielectric with copper coating, which can be etched and used either as the ground plane or radiating patch, in the innovative corrugated alternating arrangement. This invention also provides excellent impedance matching by adjusting the location of the coaxial feed means relative to the location of the electrical short on the narrow end of the radiating patch. The 360° azimuth radiation pattern variation was within 0.5 dB. It is noted that the variation in radiation magnitude can be further reduced by making the width of the narrow section of the radiating patch even smaller, which should also result in substantially more antenna size reduction.

Prior art microstrip antennas with patches typically provide two edges that contribute to the radiation of the antenna: the edge furthest from the short in the narrow strip that is 360° around the cylinder which is $2\Pi r$ wide and the edge at the junction which is $2\Pi r-2t$ wide. In those cases, the inner conductor of the prior art cylindrical microstrip would be the ground plane. At a fixed frequency and material with a given dielectric constant, the cylindrical compact antenna needs a specific length in order to resonate. In accordance with the present invention, the total cylindrical antenna length could be shortened considerably if the length of the dielectric substrate under the radiating patch is folded several times, so long as the radiating edges remain on the same side by facing the outside of the cylinder and the number of such layers is an odd-number. Additionally, it is also possible to fold the narrow section of the radiating patch at a 90° angle one or more times to further shorten the total antenna length.

The shortened cylindrical microstrip antenna of the present invention provides more antenna efficiency than currently available antennas. This invention's antennas can achieve more than an 80% antenna efficiency, which compares favorably with smaller monopole and dipole antennas of comparable size achieving an antenna efficiency of less than about 10%. The impedance transition length is orthogonal to the second patch width, $W_2$. Also, it is possible for the coaxial feed means to be an SMA connector.

Referring now to FIG. 4, there is depicted a side view of the corrugated alternating three-layered embodiment of the shortened cylindrical microstrip antenna 30, comprising a radiating patch 31 stacked on a tubular microstrip substrate 32 that is composed of a ceramic material. The radiating patch 31 is wrapped partially around the tubular microstrip substrate 32, which, in turn, fits closely around the cylindrical ground plane 33, which is either a copper coating or laminate on the microstrip material, but could also be a separate thin copper film or other good conducting film. The radiating patch 31, which could also be copper coating on microstrip material, further comprises a patch section 34 that wraps partially around the dielectric microstrip substrate 32 and a narrow section 35 that is connected to a coaxial feed means 36 and extends perpendicularly across the microstrip substrate 32. FIG. 4 also depicts an edge 37 along the patch section 34.

FIG. 4 also illustrates one basic feature of this invention which is establishing a junction 39 in the middle of the radiating patch 31 to shorten the length of the impedance transition from the center point, where the wave impedance vanishes, to the patch edge at the end of narrow section 35, where the impedance becomes very large. FIG. 4 depicts a simple example of two rectangular sections 34 and 35, respectively, of different widths connected at a junction point 39 where the patch edge of narrow section 35 is electrically shorted. The effective resistive impedance near the junction point 39 of patch section 34 is greatly reduced by the presence of the junction 39 of the patch section 34 and narrow section 35.

FIG. 5 is a side cross sectional view of the corrugated alternating three-layered embodiment of the shortened cylindrical microstrip antenna 30, not drawn to scale, with alternating layers of the radiating patch 31, dielectric substrate 32, and copper ground plane 33 that illustrate this invention's corrugated alternating structure. Referring now to FIG. 5, narrow section 35 of the radiating patch 31 is connected to the coaxial feed means 36 which projects downward through the dielectric substrate 32 to ground plane layer 33. On the left side of the antenna 30, the dielectric substrate 32 is interleaved with alternating layers from the wide section 34 and the ground plane 33 with the dielectric substrate 32 forming a compressed "S" pattern when the drawing is held sideways. On the right side of the antenna 30, the dielectric substrate 32 is interleaved with alternating layers from the radiating sleeve 31, wide section 34 and the ground plane 33 with the dielectric substrate 32 forming a similar compressed "S" pattern. Edges 37 and 38 are shown on both sides of the corrugated structure. FIG. 5 also includes a number of representative dimensions. If the FIG. 5 antenna 30 was fabricated as a single layer cylindrical antenna, the length of the patch section 34 would have been approximately 67.5 mm (10 mm+1.5 mm+25 mm+31 mm) and the length of the narrow section 35 would have been 60 mm (20 mm+40 mm), for an antenna with a total length of 127.5 mm. Therefore, this invention's corrugated alternating structure advantageously provides an antenna with a considerably reduced length as compared with prior art antennas.

A prototype cylindrical antenna of the multilayer cylindrical structure was made of a thin microstrip material, since this material was readily available with a thin copper coat on it. The relative dielectric constant of this material was 10.2 with a thickness of 0.036 mm. For simplicity of fabrication, an antenna with three concentric layers was fabricated and the narrow strip was folded once. Laboratory testing revealed a resonant frequency of 63 MHz, which is depicted in the FIG. 6 chart. Those skilled in the art will readily appreciate that achieving this frequency from a cylindrical antenna of 40 mm in diameter and electrical length of only 37 mm is quite significant. If this antenna was a single layer cylindrical antenna, the length of the patch section 34 would have been approximately 67.5 mm and the length of the narrow strip 35 would have been 60 mm for the total length of 127.5 mm. Therefore providing this invention's three-layered antenna with the innovative corrugated alternating structure shrinks antenna size so that it is considerably shorter than prior art antennas.

Those skilled in the art may readily appreciate that the interleaving of radiating patches 31, dielectric substrate layers 32, and ground plane layers 33 results in a substantially shortened antenna length. The ground plane layers 33 can be a continuous piece of conductive material or separate segments of conductive material fastened together by solder or a suitable epoxy and are composed of any ceramic material in accordance with this invention. The radiating patch 31 may be made from any conductive metal, implemented with either a thin film or etching of copper on the microstrip material, and in the preferred embodiment it is composed of copper.

Figure 1:
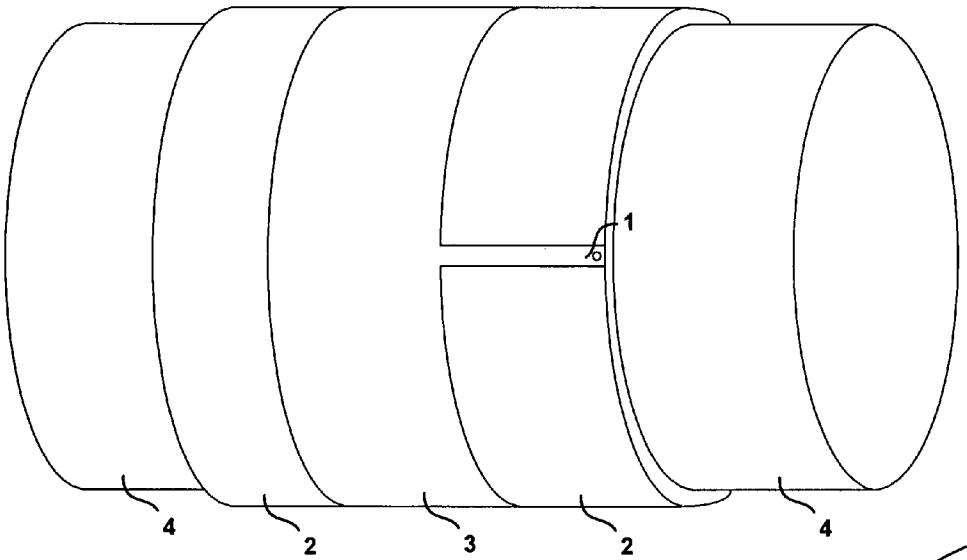
FIG. 1 Prior Art
FIG. 1 is a side view of a prior art cylindrical microstrip antenna.
Figure 2:
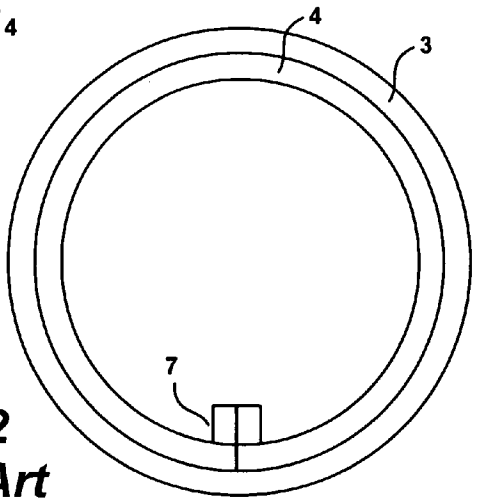
FIG. 2 Prior Art
FIG. 2 is a front view of the FIG. 1 prior art antenna.
Figure 3:
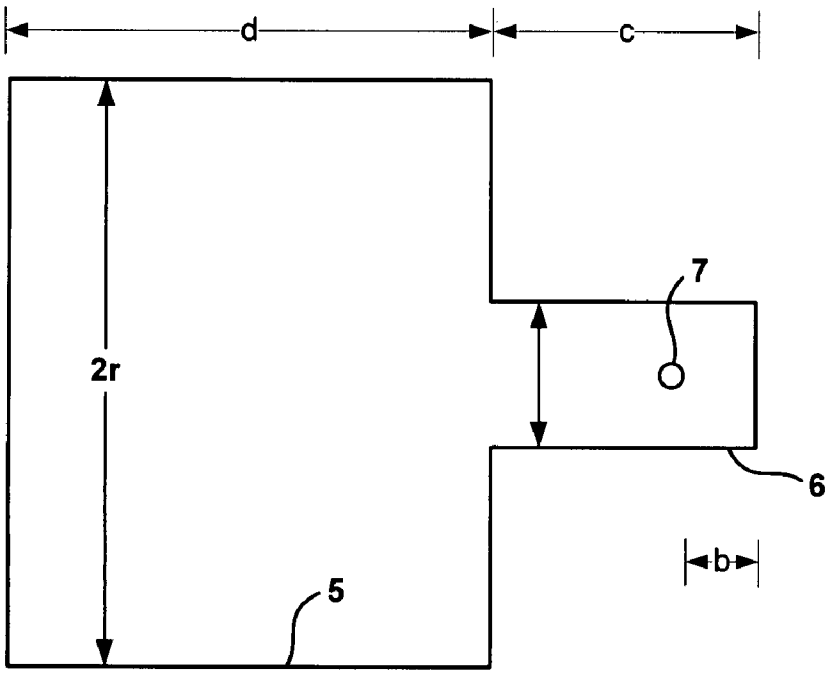
FIG. 3 Prior Art
FIG. 3 is a top view of the radiating patch of the FIG. 1 prior art antenna.

The FIGS. 1-3 prior art single layer embodiment provides a reduced antenna length of 10 times the prior art while this invention's triple layered antenna 30 with higher dielectric constant ceramic microstrip material can provide an even shorter antenna. This makes size reduction of 40 or more times the antenna length is now possible. It is also noted that an odd number of dielectric substrate layers is required and leads to an omnidirectional antenna pattern.

FIG. 7 is a cross sectional view taken through the cylindrical axis of the corrugated alternating seven-layered embodiment of the ceramic cylindrical microstrip antenna 40, which is a seven layer embodiment that is not drawn to scale. The corrugated alternating seven-layered embodiment of the shortened ceramic cylindrical microstrip antenna 40 comprises tightly fitted ceramic thin cylinders 42, or thin ceramic planar microstrip material folded into cylinders, between these ceramic cylinders made from very thin alternating layers of copper film, or most likely a ceramic material with copper film coating that is etched as needed, to function as either part of the ground plane 43 or part of the radiating patch 41 corrugated alternating structure of this invention. Except for the additional folding due to the seven alternating corrugated layers, the configuration of the radiating patch 41 is similar to that depicted in FIG. 4. Referring now to FIG. 7, narrow section 45 of the radiating patch 41 is connected to the coaxial feed 49 and this narrow section 45 extends to the top left side of the structure and is shorted to the ground plane 43 in a manner that is similar to the FIG. 5 three-layer antenna 30 embodiment. As compared with the three-layered embodiment depicted in FIGS. 4 and 5, this seven-layered corrugated alternating antenna structure 40 advantageously provides an even greater antenna length reduction because the effective length between the two main radiating edges 47 and 48 through seven layers of ceramic dielectric is substantially increased. The distance between the two radiating surfaces 37 and 38 of FIG. 5 through three ceramic layers is about 67 mm. The seven layer antenna adds 25 mm for each additional layer, or 100 mm more, and this will provide more than twice the desired antenna length reduction. The corrugated alternating seven-layered shortened cylindrical microstrip antenna 40 of the present invention operates in a manner that is similar to the three-layer embodiment depicted in FIGS. 4-5.

The main advantage of this invention's corrugated alternating shortened cylindrical microstrip antenna structures over other VHF or lower frequency omnidirectional microstrip antennas is that although the distance between the two radiating edges is small, the electrical length of the electromagnetic wave between these radiating edges is long due to the corrugated alternating feature. This is because the wave has to travel between many layers of dielectric ceramic or other microstrip material, with part of ground plain at one side and part of the radiating patch the other side of these concentric dielectric cylinders. This effectively shrinks the antenna length at the extremely small expense of making the diameter slightly larger due to additional layers of thin dielectric material with thinner copper coatings. For example, in FIG. 7, the physical distance between radiating edges 47 and 48 is small compared to the electrical distance the wave has to travel between seven layers of ceramic in between the many layers of ground plane 43 and patch 44.

The present invention also encompasses a method for providing an electrically small, shortened low frequency cylindrical microstrip antenna in a corrugated alternating layered structure, comprising the steps of forming a cylindrical, ceramic microstrip substrate; fitting the cylindrical, ceramic microstrip substrate closely around a copper-coated cylindrical ground plane; forming a radiating patch with a patch section, a narrow section, a middle section, a center point, and a junction point; wrapping the patch section partially around the cylindrical microstrip substrate; connecting the narrow section to a coaxial feed means; and positioning the junction point in the middle section to shorten an impedance transition length from the center point to a patch edge of the narrow section. The methods continue with the steps of folding the radiating patch; interleaving the radiating patch, the cylindrical, ceramic microstrip substrate, and the copper-coated cylindrical ground plane into the corrugated alternating configuration; reducing an effective resistive impedance near the junction point with the impedance transition length; generating an electric field with the junction point that decreases the impedance transition length to a decreased impedance transition length; and providing a shortened low frequency antenna length with said radiating patch and said copper-coated cylindrical ground plane being folded and interleaved into the corrugated alternating configuration with an elongated radiating surface within a confined space.

It will be understood that the embodiments described herein are merely exemplary and that a person skilled in the art may make many variations and modifications to the described embodiments utilizing functionally equivalent elements to those described. Any variations or modifications to the invention just described are intended to be included within the scope of said invention as defined by the appended claims.

What I claim is:

1. A shortened HF cylindrical microstrip antenna, comprising:

a cylindrical, ceramic microstrip substrate;

said cylindrical, ceramic microstrip substrate fits closely around a copper-coated cylindrical ground plane;

a radiating patch having a patch section, a narrow section, a middle section, a center point, and a junction point;

said patch section being wrapped partially around said cylindrical microstrip substrate;

said narrow section being connected to a coaxial feed means;

said junction point being located in said middle section to shorten an impedance transition length from said center point to a patch edge of said narrow section;

said radiating patch, said cylindrical, ceramic microstrip substrate, and said copper-coated cylindrical ground plane being folded and interleaved into a corrugated alternating configuration;

said impedance transition length reduces an effective resistive impedance near said junction point; and said junction point providing an electric field that decreases said impedance transition length to a decreased impedance transition length and said radiating patch and said copper-coated cylindrical ground plane being folded and interleaved into said corrugated alternating configuration provide an elongated radiating surface within a confined space allowing a shortened HF antenna length.

2. The shortened HF cylindrical microstrip antenna, as recited in claim 1, further comprising said narrow section having a grounded end shorted to said ground plane.

3. The shortened HF cylindrical microstrip antenna, as recited in claim 2, further comprising:

said patch section being rectangular; and said narrow section being rectangular.

4. The shortened HF cylindrical microstrip antenna, as recited in claim 3, further comprising said corrugated alternating structure having multiple odd-numbered layers.

5. The shortened HF cylindrical microstrip antenna, as recited in claim 4, further comprising said corrugated alternating structure having three layers.

6. A shortened VHF cylindrical microstrip antenna, comprising:

a cylindrical, ceramic microstrip substrate;

said cylindrical, ceramic microstrip substrate fits closely around a copper-coated cylindrical ground plane;

a radiating patch having a patch section, a narrow section, a middle section, a center point, and a junction point;

said patch section being wrapped partially around said cylindrical microstrip substrate;

said narrow section being connected to a coaxial feed means;

said junction point being located in said middle section to shorten an impedance transition length from said center point to a patch edge of said narrow section;

said radiating patch, said cylindrical, ceramic microstrip substrate, and said copper-coated cylindrical ground plane being folded and interleaved into a corrugated alternating configuration;

said impedance transition length reduces an effective resistive impedance near said junction point; and said junction point providing an electric field that decreases said impedance transition length to a decreased impedance transition length and said radiating patch and said copper-coated cylindrical ground plane being folded and interleaved into said corrugated alternating configuration provide an elongated radiating surface within a confined space allowing a shortened VHF antenna length.

7. The shortened VHF cylindrical microstrip antenna, as recited in claim 6, further comprising said narrow section having a grounded end shorted to said ground plane.

8. The shortened VHF cylindrical microstrip antenna, as recited in claim 7, further comprising:

said patch section being rectangular; and said narrow section being rectangular.

9. The shortened VHF cylindrical microstrip antenna, as recited in claim 8, further comprising said corrugated alternating structure having multiple odd-numbered layers.

10. The shortened VHF cylindrical microstrip antenna, as recited in claim 9, further comprising said corrugated alternating structure having seven layers.

11. A method for providing an electrically small, shortened low frequency cylindrical microstrip antenna in a corrugated alternating layered structure, comprising the steps of:

forming a cylindrical, ceramic microstrip substrate;

fitting said cylindrical, ceramic microstrip substrate closely around a copper-coated cylindrical ground plane;

forming a radiating patch with a patch section, a narrow section, a middle section, a center point, and a junction point;

wrapping said patch section partially around said cylindrical microstrip substrate;

connecting said narrow section to a coaxial feed means;

positioning said junction point in said middle section to shorten an impedance transition length from said center point to a patch edge of said narrow section;

folding said radiating patch;

interleaving said radiating patch, said cylindrical, ceramic microstrip substrate, and said copper-coated cylindrical ground plane into said corrugated alternating configuration;

reducing an effective resistive impedance near said junction point with said impedance transition length;

generating an electric field with said junction point that decreases said impedance transition length to a decreased impedance transition length; and providing a shortened low frequency antenna length with said radiating patch and said copper-coated cylindrical ground plane being folded and interleaved into said corrugated alternating configuration with an elongated radiating surface within a confined space.

12. The method for providing an electrically small, shortened low frequency cylindrical microstrip antenna in a corrugated alternating layered structure, as recited in claim 11, further comprising the step of shorting a grounded end of said narrow section to said ground plane.

13. The method for providing an electrically small, shortened low frequency cylindrical microstrip antenna in a corrugated alternating layered structure, as recited in claim 12, further comprising the steps of:

forming said patch section into a rectangular shape; and forming said narrow section into a rectangular shape.

14. The method for providing an electrically small, shortened low frequency cylindrical microstrip antenna in a corrugated alternating layered structure, as recited in claim 13, further comprising the step of configuring said corrugated alternating structure with multiple odd-numbered layers.

15. The method for providing an electrically small, shortened low frequency cylindrical microstrip antenna in a corrugated alternating layered structure, as recited in claim 14, further comprising the step of configuring said corrugated alternating structure with three layers.

16. The method for providing an electrically small, shortened low frequency cylindrical microstrip antenna in a corrugated alternating layered structure, as recited in claim 14, further comprising the step of configuring said corrugated alternating structure with seven layers.

17. The method for providing an electrically small, shortened low frequency cylindrical microstrip antenna in a corrugated alternating layered structure, as recited in claim 14, wherein said shortened low frequency cylindrical microstrip antenna is an HF antenna.

18. The method for providing an electrically small, shortened low frequency cylindrical microstrip antenna in a corrugated alternating layered structure, as recited in claim 14, wherein said shortened low frequency cylindrical microstrip antenna is an VHF antenna.

* * * * *